US005918815A

United States Patent [19]

Wu

[11] Patent Number: 5,918,815

[45] **Date of Patent: *Jul. 6, 1999**

[54] PAINT CUP MOUNTING ARRANGEMENT OF A PAINT SPRAY GUN

[76] Inventor: Yu-Chih Wu, No. 418-5, Min-Chu Rd., Sec. 1, Tan-Tzu Hsiang, Taichung County, Taiwan

[ * ] Notice: This patent is subject to a terminal disclaimer.

[21] Appl. No.: 08/955,521

[22] Filed: Oct. 22, 1997

[51] Int. Cl.[6] ..... B05B 7/30

[52] U.S. Cl. ..... 239/345; 239/346; 239/379; 239/DIG. 14; 285/361

[58] Field of Search ..... 239/302, 310, 239/316, 318, 345, 346, 377, 379, 407, 419, DIG. 14; 285/360, 361, 375, 376, 396, 401, 402

[56] References Cited

U.S. PATENT DOCUMENTS

| | | | |
|---|---|---|---|
| 930,087 | 8/1909 | Reich | 239/345 |
| 3,003,704 | 10/1961 | Roche | 239/345 |
| 4,955,544 | 9/1990 | Kopp | 239/407 X |
| 4,978,072 | 12/1990 | Kurowski | 239/346 |
| 5,803,360 | 8/1998 | Spitznagel | 239/345 |
| 5,810,258 | 9/1998 | Wu | 239/346 |

*Primary Examiner*—Andres Kashnikow
*Assistant Examiner*—Steven J. Ganey
*Attorney, Agent, or Firm*—Rosenberg, Klein & Bilker

[57] ABSTRACT

A paint cup mounting arrangement including a mounting cylinder fastened to a paint spray gun by a screw joint and having a coupling flange around the periphery, a socket sleeved onto the mounting cylinder and having an inward coupling flange forced into engagement with the coupling flange of the mounting cylinder, a paint cup fastened to the socket by a screw joint, a paint guide tube mounted within the mounting cylinder and the socket and sealed by rubber seal rings and adapted to guide paint from the paint cup to the paint spray gun, and a compression spring mounted within the mounting cylinder around the paint guide tube to impart a backward pressure to the socket and to force, the paint cup being adjusted to a vertical position by forcing the socket inwards to compress the compression spring and to disengage the coupling flange of the socket from the coupling flange of the mounting cylinder and then turning the socket about the mounting cylinder.

6 Claims, 4 Drawing Sheets

PAINT CUP MOUNTING ARRANGEMENT OF A PAINT SPRAY GUN

BACKGROUND OF THE INVENTION

The present invention relates to paint spray guns, and more specifically to a paint cup mounting arrangement for a paint spray gun which permits the paint cup to be conveniently adjusted to a vertical position during a paint-spraying operation.

FIG. 1 shows a regular paint spray gun in which the paint cup 11 is fixedly fastened to the casing 100 of the paint spray gun. Because the paint cup 11 is fixedly secured to the casing 100 of the paint spray gun, its angular position is not adjustable. If the paint spray gun is held in a tilted position, paint may flow out of the paint cup. Further, because the paint cup 11 is not detachable, the user cannot replace the paint cup 11 subject to the desired volume.

SUMMARY OF THE INVENTION

The present invention has been accomplished to provide a paint cup mounting arrangement which eliminate the aforesaid problems. According to one aspect of the present invention, the paint cup mounting arrangement comprises a mounting cylinder fastened to a paint spray gun by a screw joint, a socket sleeved onto the mounting cylinder and turned thereabout, a paint cup fastened to the socket, and a paint guide tube mounted within the mounting cylinder and the socket and sealed by a small rubber seal ring and a big rubber seal ring and adapted to guide paint from the paint cup to the paint spray gun, the paint cup being adjusted to a vertical position by turning the socket about the mounting cylinder. According to another aspect of the present invention, the paint cup is detachably fastened to the socket by threading a threaded bottom neck thereof into a radial screw hole of the socket. According to still another aspect of the present invention, a compression spring is mounted around the paint guide tube and stopped between an inside wall of the mounting cylinder and the big rubber seal ring of the paint guide tube, the compression spring imparting a backward pressure to the socket through the big rubber seal ring, causing the coupling flange of the socket to be firmly retained in engagement with the coupling flange of the mounting cylinder.

DETAILED DESCRIPTION OF THE PREFERRED EMBODIMENT

Figure 1:
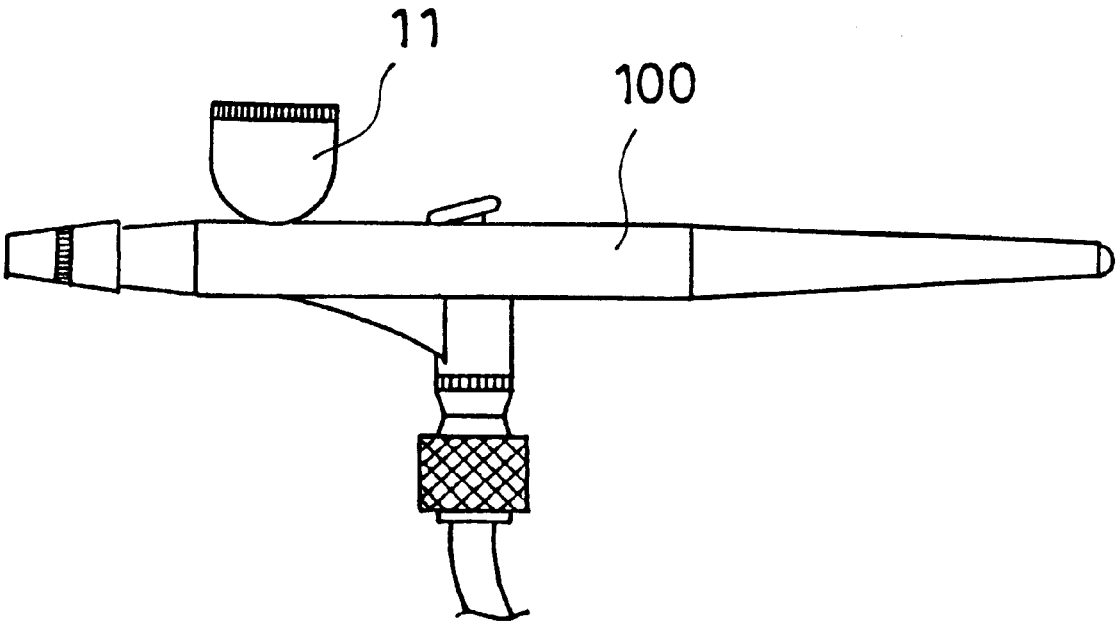
FIG.1 PRIOR ART
FIG. 1 is a plain view of a paint spray gun according to the prior art.
Figure 2:
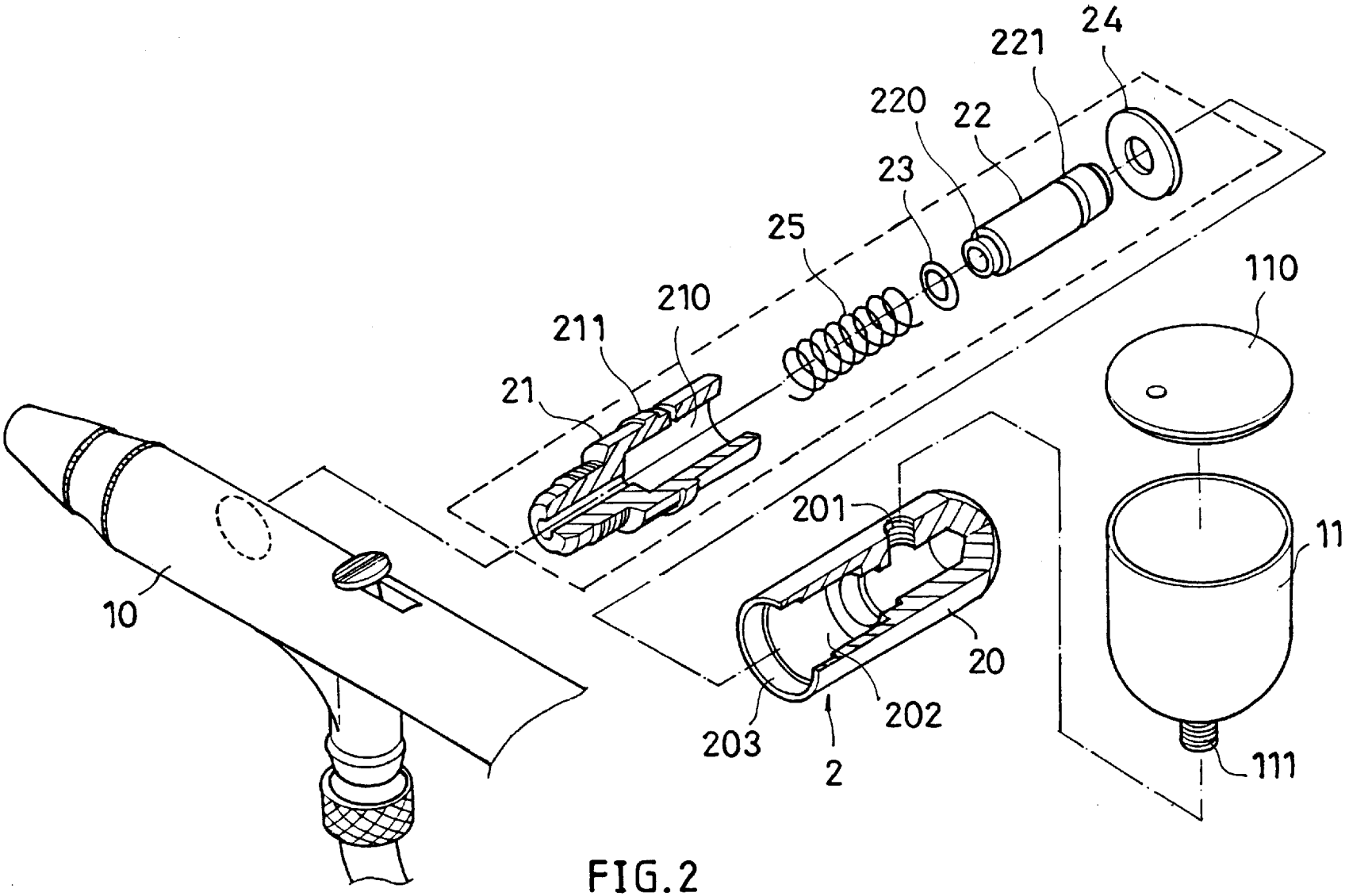
FIG. 2 is an exploded view of the present invention.
Figure 3:
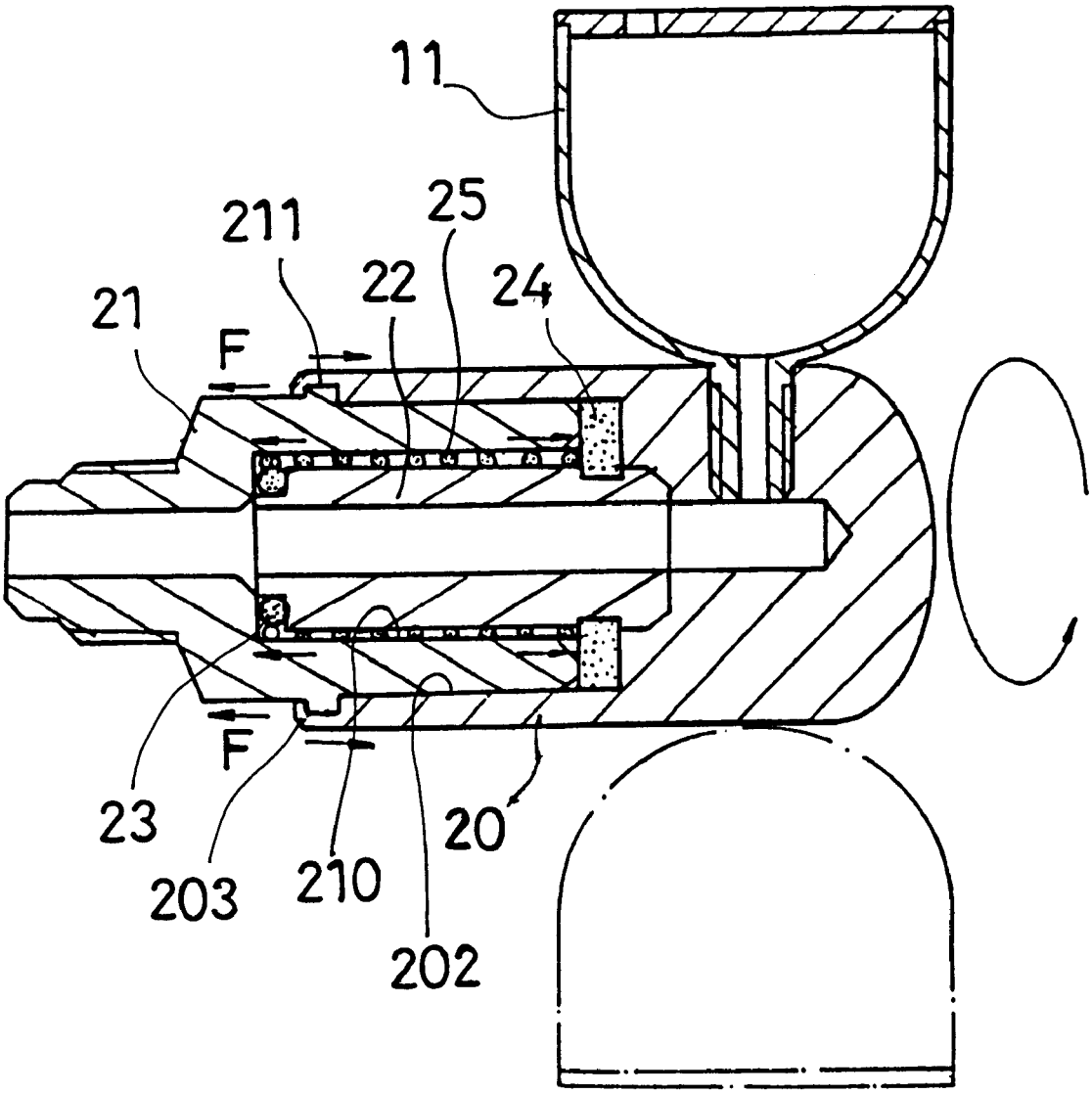
FIG. 3 is a sectional view showing the adjustment of the angular position of the paint cup according to the present invention.

Referring to FIGS. 2 and 3, a rotary mounting device 2 is installed in a paint spray gun 10 to hold a paint cup 11, for permitting paint to be guided out of the paint cup 11 into the paint spray gun 10 for spraying over the object to be painted.

The rotary mounting device 2 comprises a socket 20, a mounting cylinder 21, a paint guide tube 22, and a compression spring 25. The socket 20 comprises a stepped receiving chamber 202 longitudinally extended to its front open side, a screw hole 201 through the periphery in Communication with the stepped receiving chamber 202, and an inward coupling flange 203 raised from its inside wall around its front open side. The mounting cylinder 21 is mounted in the broad front half of the stepped receiving chamber 202 of the socket 20, comprising a longitudinally extended cylindrical receiving chamber 210, and coupling flange 211 raised around the periphery in the middle and forced into engagement with the coupling flange 203 of the socket 20. The paint guide tube 22 is mounted in the receiving chamber 210 of the mounting cylinder 21 and the narrow rear half of the receiving chamber 202 of the socket 2, having a front neck 220 and an annular groove 221 around the periphery. A small rubber seal ring 23 and a big rubber seal ring 24 are respectively mounted on the front neck 220 and annular groove 221 of the paint guide tube 22, and forced into close contact with the periphery of the receiving chamber 210 of the mounting cylinder 21 and the periphery of the receiving chamber 202 of the socket 20 respectively. The paint cup 11 is covered with a cap 110, having a threaded hollow neck 111 at its bottom side threaded into the screw hole 201 of the socket 20. The compression spring 25 is mounted within the receiving chamber 210 of the mounting cylinder 21 around the paint guide tube 22, having its front end stopped against an inside wall of the mounting cylinder 21 and its rear end stopped against the big rubber seal ring 24. The compression spring 25 imparts a backward pressure to the socket 20 through the big rubber seal ring 24, causing the inward coupling flange 203 of the socket 20 to be firmly retained in engagement with the coupling flange 211 of the mounting cylinder 21. When the rotary mounting device 2 is assembled, the big rubber seal ring 24 is disposed outside the mounting cylinder 21 and stopped at a step between the broad front half and narrow rear half of the stepped receiving chamber 202 of the socket 20, and the socket 20 can be turned about the mounting cylinder 21 to adjust the angular position of the paint cup 11, and paint is allowed to be guided out of the threaded hollow neck 111 of the paint cup 11 through the rear end of the receiving chamber 202 of the socket 20, the paint guide tube 22, the mounting cylinder 21 into the paint spray gun 10.

Figure 4:
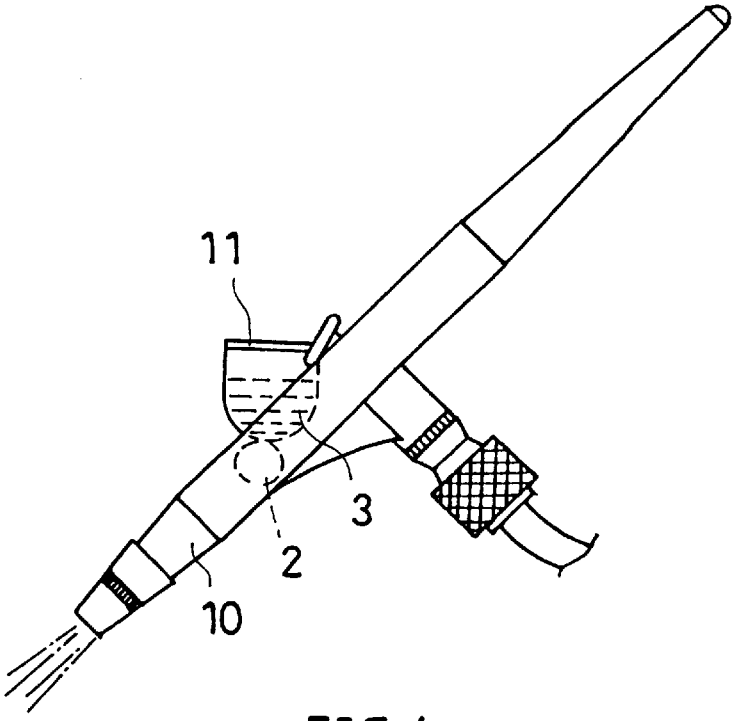
FIG. 4 is an applied view of the present invention, showing the paint spray gun held in a downward spraying position, the paint cup retained in a vertical position.
Figure 5:
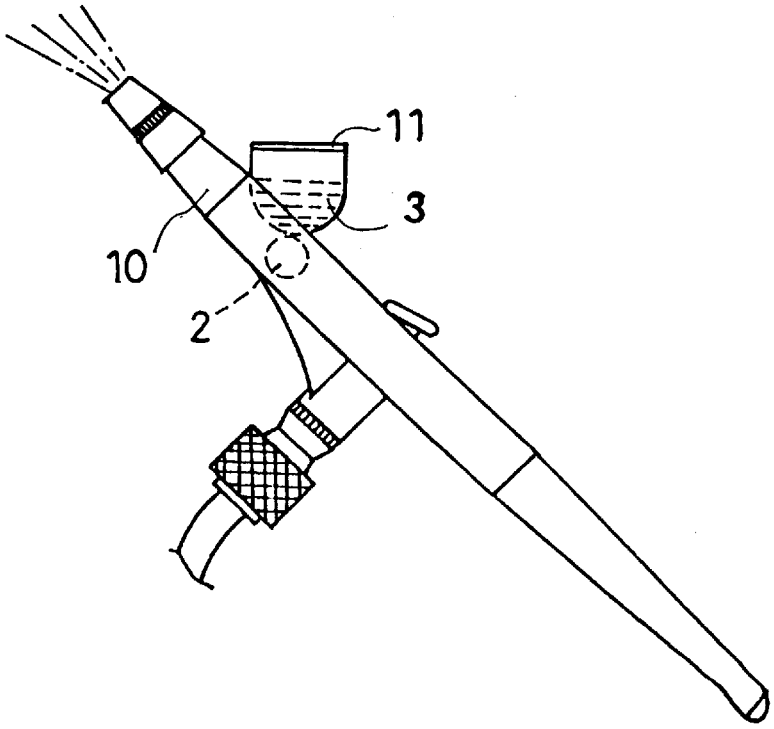
FIG. 5 is another applied view of the present invention, showing the paint spray gun held in an upward spraying position, the paint cup retained in a vertical position.

Referring to FIGS. 3, 4 and 5, when in use, the paint cup 11 is filled up with paint 3. When the paint spray gun 10 is turned downwards for painting a lower area of the workpiece, the socket 20 is forced inwards relatively to the mounting cylinder 21 to compress the compression spring 25 and to disengage its coupling flange 203 from the coupling flange 211 of the mounting cylinder 21 and then turned about the mounting cylinder 21 to move the paint cup to a vertical position (see FIG. 4). When the hand is released from the socket 20 after adjustment, the compression spring 25 immediately returns to its former shape and imparts a backward pressure to the socket 20, thereby causing the coupling flange 203 of the socket 20 to be forced into engagement with the coupling flange 211 of the mounting cylinder 21 again, and therefore the socket 20 is retained in place to hold the paint cup 11 in vertical. On the contrary, when the paint spray gun 10 is turned upwards for painting an upper area of the workpiece, the socket 20 is turned about the mounting cylinder 21 in the reversed direction to keep the paint cup 11 in vertical (see FIG. 5). Therefore, the pain cup 11 can be conveniently adjusted to a vertical position when the paint spray gun 10 is held in any of a variety of spraying angles.

While only one embodiment of the present invention has been shown and described, it will be understood that various modifications and changes could be made thereunto without departing from the spirit and scope of the invention disclosed.

What the invention claimed is:

1. A mounting assembly for operably and adjustably mounting a paint cup to a paint spray gun comprising:

(a) a mounting cylinder adapted for fixed coupling to the paint spray gun for guiding thereto a flow of paint from the paint cup, said mounting cylinder including a radially protruding coupling flange, said mounting cylinder defining a receiving chamber extending longitudinally therein;

(b) a socket coaxially and displaceably coupled to said mounting cylinder, said socket having formed therein a longitudinally extending stepped receiving chamber, said stepped receiving chamber having longitudinally displaced front and rear sections, said front section having a greater diametric dimension than said rear section, said front section receiving at least a portion of said mounting cylinder, said socket having formed therethrough a screw hole disposed in open communication with said rear section, said socket having formed thereon a coupling flange protruding radially into said stepped receiving chamber for engagement with said coupling flange of said mounting cylinder; and, (c) a paint guide tube cooperatively received within said receiving chamber of said mounting cylinder and said rear section of said stepped receiving chamber of said socket for conveying the flow of paint from the paint cup to the mounting cylinder.

2. The mounting assembly as recited in claim 1 wherein said socket is coupled to said mounting cylinder in resiliently biased manner, said socket being biased longitudinally away from said mounting cylinder.

3. The mounting assembly as recited in claim 1 wherein said paint guide tube includes a front neck portion extending axially from a tubular body portion, said tubular body portion having an annular groove formed therein.

4. The mounting assembly as recited in claim 3 further comprising a first resilient seal ring coaxially coupled to said neck portion of said paint guide tube and a second resilient seal ring engaging said annular groove of said tubular body portion of said paint guide tube, said second resilient seal ring abutting portions of both said mounting cylinder and said socket.

5. A mounting assembly for operably and adjustably mounting a paint cup to a paint spray gun comprising:

(a) a mounting cylinder adapted for fixed coupling to the paint spray gun for guiding thereto a flow of paint from the paint cup, said mounting cylinder including a radially protruding coupling flange, said mounting cylinder defining a receiving chamber extending longitudinally therein;

(b) a socket coaxially and displaceably coupled to said mounting cylinder, said socket having formed therein a longitudinally extending stepped receiving chamber, said stepped receiving chamber having longitudinally displaced front and rear sections, said front section having a greater diametric dimension than said rear section, said front section receiving at least a portion of said mounting cylinder, said socket having formed therethrough a screw hole disposed in open communication with said rear section, said socket having formed thereon a coupling flange protruding radially into said stepped receiving chamber for engagement with said coupling flange of said mounting cylinder;

(c) a paint guide tube cooperatively received within said receiving chamber of said mounting cylinder and said rear section of said stepped receiving chamber of said socket for conveying the flow of paint from the paint cup to the mounting cylinder; and, (d) a compression spring coaxially coupled to said paint guide tube, said compression spring axially biasing said socket away from said mounting cylinder;

whereby said coupling flange of said socket is maintained in releasable engagement with said coupling flange of said mounting cylinder.

6. A mounting assembly for operably and adjustably mounting a paint cup to a paint spray gun comprising:

(a) a mounting cylinder adapted for fixed coupling to the paint spray gun for guiding thereto a flow of paint from the paint cup, said mounting cylinder including a radially protruding coupling flange, said mounting cylinder defining a receiving chamber extending longitudinally therein;

(b) a socket coaxially and displaceably coupled to said mounting cylinder, said socket having formed therein a longitudinally extending stepped receiving chamber, said stepped receiving chamber having longitudinally displaced front and rear sections, said front section having a greater diametric dimension than said rear section, said front section receiving at least a portion of said mounting cylinder, said socket having formed therethrough a screw hole disposed in open communication with said rear section, said socket having formed thereon a coupling flange protruding radially into said stepped receiving chamber for engagement with said coupling flange of said mounting cylinder;

(c) a paint guide tube cooperatively received within said receiving chamber of said mounting cylinder and said rear section of said stepped receiving chamber of said socket for conveying the flow of paint from the paint cup to the mounting cylinder, said paint guide tube having a front neck portion extending axially from a tubular body portion, said tubular body portion having an annular groove formed therein;

(d) a first resilient seal ring coaxially coupled to said neck portion of said paint guide tube and a second resilient seal ring engaging said annular groove of said tubular body portion of said paint guide tube, said second resilient seal ring abutting portions of both said mounting cylinder and said socket; and, (e) a compression spring coaxially coupled to said paint guide tube and extending axially between said second resilient seal ring and said mounting cylinder, said compression spring axially biasing said socket away from said mounting cylinder;

whereby said coupling flange of said socket is maintained in releasable engagement with said coupling flange of said mounting cylinder.

* * * * *